US007993055B2

(12) United States Patent
Nurse et al.

(10) Patent No.: US 7,993,055 B2
(45) Date of Patent: Aug. 9, 2011

(54) METHOD AND APPARATUS FOR ALERTING A PERSON AT MEDICINE DOSING TIMES

(76) Inventors: Lloyd Cleveland Nurse, Decatur, GA (US); Darien Okinza Nurse, Decatur, GA (US)

( * ) Notice: Subject to any disclaimer, the term of this patent is extended or adjusted under 35 U.S.C. 154(b) by 70 days.

(21) Appl. No.: 12/466,332

(22) Filed: May 14, 2009

(65) Prior Publication Data

US 2010/0220553 A1 Sep. 2, 2010

Related U.S. Application Data

(63) Continuation-in-part of application No. 12/079,876, filed on Mar. 28, 2008, now abandoned.

(51) Int. Cl.
*G04B 37/00* (2006.01)

(52) U.S. Cl. ..... 368/277; 368/244

(58) Field of Classification Search ..... 368/10, 368/244, 277

See application file for complete search history.

(56) References Cited

U.S. PATENT DOCUMENTS

| | | | | |
|---|---|---|---|---|
| 4,258,354 | A | 3/1981 | Carmon | |
| 6,018,289 | A * | 1/2000 | Sekura et al. | 340/309.4 |
| 6,198,383 | B1 * | 3/2001 | Sekura et al. | 340/309.4 |
| 6,337,836 | B1 | 1/2002 | Eidelson | |
| 6,529,446 | B1 * | 3/2003 | de la Huerga | 368/10 |
| 6,545,592 | B2 | 4/2003 | Weiner | |
| 6,667,936 | B1 | 12/2003 | Ditzig | |
| 6,724,298 | B2 | 4/2004 | Smith | |
| 6,812,825 | B1 | 11/2004 | Volk | |
| 6,817,192 | B2 | 11/2004 | Ector | |
| 6,845,064 | B2 | 1/2005 | Hildebrandt | |
| 6,934,220 | B1 | 8/2005 | Cruitt | |
| 7,199,700 | B1 | 4/2007 | McPherson | |
| 7,330,101 | B2 * | 2/2008 | Sekura | 340/309.4 |
| 7,362,660 | B2 | 4/2008 | Hildebrandt | |
| 7,362,663 | B2 * | 4/2008 | Kagan | 368/327 |
| 7,639,120 | B2 * | 12/2009 | Sekura | 340/309.4 |
| 2003/0070681 | A1 | 4/2003 | Rydgren | |
| 2003/0151499 | A1 * | 8/2003 | Huang | 340/309.16 |

(Continued)

OTHER PUBLICATIONS

International Search Report from corresponding PCT Appln. No. PCT/US2010/034448 mailed Jan. 20, 2011.

*Primary Examiner* — Sean Kayes

(74) *Attorney, Agent, or Firm* — LeonardPatel PC; Michael A. Leonard, II; Sheetal S. Patel

(57) ABSTRACT

Disclosed are apparatus for assisting a person in the correct administration of medicine and methods for beneficially using such a device. The apparatus comprises an electronic timing mechanism which executes a dosing schedule, the dosing schedule being comprised of at least one dosing time interval. One or more annunciators are activated at the end of at least one dosing interval thereby alerting a person that it is time to take a dose of medicine. Included are attachment means, such as a pressure sensitive adhesive, for attachment to a medicine container. Construction is with materials and structures that confer to the device the flexibility required to physically conform to curved objects such as typically encountered in prescribed medications. Alerts from the device may be visible, audible, vibratory, or any combination thereof. No human readable time is displayed. At least one switch is provided for human interaction with the device. Human readable information may be visible on the device for quick dosing schedule identification. The dosing schedule may be preprogrammed and unalterable. In other embodiments the dosing schedule may be reprogrammable.

28 Claims, 11 Drawing Sheets

U.S. PATENT DOCUMENTS

2004/0156418 A1* 8/2004 Debord et al. ..... 374/103
2006/0061454 A1* 3/2006 Debord et al. ..... 340/309.16
2006/0146654 A1* 7/2006 Yeager ..... 368/281
2006/0167345 A1 7/2006 Vespasiani
2006/0187002 A1* 8/2006 Terenna ..... 340/309.16
2006/0187003 A1* 8/2006 Terenna ..... 340/309.16
2006/0227669 A1* 10/2006 Pennaz et al. ..... 368/327
2007/0091726 A1 4/2007 Stauffer
2008/0117719 A1* 5/2008 Hildebrandt ..... 368/10
2009/0027213 A1* 1/2009 Debord et al. ..... 340/588
2009/0040874 A1 2/2009 Rooney
2009/0209896 A1* 8/2009 Selevan ..... 602/41
2011/0041845 A1* 2/2011 Solomon et al. ..... 128/203.12

* cited by examiner

20

| Index | Dosing Schedule |
|---|---|
| 1 | Dosing Schedule Entry 1 |
| 2 | Dosing Schedule Entry 2 |
| ⋮ | ⋮ |
| N | Dosing Schedule Entry N |

FIG 6A

21

| Data Field | Dosing Schedule Entry |
|---|---|
| Interval | Represents the time duration of the dosing interval |
| Sig_Action | Indicates which annunciators, if any, to activate at the end of the dosing interval |
| Sw_Action | Indicates what actions to take upon activation of one or more switches |
| Next | Represents the index of the next dosing schedule entry to be executed upon completion of the current entry |

FIG 6B

METHOD AND APPARATUS FOR ALERTING A PERSON AT MEDICINE DOSING TIMES

CROSS REFERENCE TO RELATED APPLICATIONS

This application is a continuation-in-part of prior application Ser. No. 12/079,876, filed Mar. 28, 2008.

STATEMENT REGARDING FEDERALLY SPONSORED RESEARCH OR DEVELOPMENT

Not Applicable.

DESCRIPTION OF ATTACHED APPENDIX

Not Applicable.

BACKGROUND

This disclosure relates generally to the field of health care. Medicines are a crucial part of the modern health care system. The safe and effective use of medicines assure their usefulness. A medication does the most benefit to a patient if it is taken in the manner prescribed by the doctor and dispensed by the pharmacist. It frequently happens that people need help in taking medicines as prescribed. One very common problem is that people forget to take a medicine dose. Missed medicine doses contribute to both drug tolerance in the body and drug resistance of pathogens, neither of which is in the best interest of patients. Another very common problem is that people take medicine doses with improper time intervals between doses. People impaired by illness, medication, or simple forgetfulness may overdose. These very common problems have negative effects on patient health. In fact, people die every year from improperly administered medication. It is therefore highly desirable to improve how well a patient follows the dosing instructions for a prescribed medicine by giving them tools to help them take their medicines in the manner prescribed.

Additional problems affect people who take multiple medications. Keeping track of dosage amount and dosing times is made more complicated when a patient has multiple medications to manage. Each medication has its own proper dosing schedule so confusion between medications can lead to dangerous under- or over-dosing situations. Furthermore, the potential danger presented by drug interactions may make it necessary to have defined time separation between certain medicines. It is therefore highly desirable to decrease the potential for confusion when a patient has to take multiple medications.

Medication is typically dispensed in a container on which medical information pertaining to that medication is attached or affixed in some way. That medical information provides crucial data as to the identity of the medication and the dosing instructions for that medication. Continued access to that crucial data is important to the patient. Transferring medication from its original dispensary packaging is something that people tend to do, especially when they have multiple medications to manage. This is especially true for the blind, the elderly, and the physically challenged. In a typical scenario, an individual might count out the amount of pills of several different medications that they anticipate taking over the course of an entire week and then transfer those pills to a plastic container having a subcompartment for each day of the week. There are risks associated with separating medication from its dispensary packaging. Any action that leads to confusion or uncertainty in the patient has the potential to contribute to over- and under-dosing situations. Its is therefore highly desirable to reduce the potential for uncertainty and confusion in the patient by allowing medications to stay in their original dispensary packing.

Today's one-cap-fits-all Child/Adult approach to medicine dosage, with limited consideration to weight, age and gender, can be significantly improved to more accurately address these factors in addition to issues such as ethnicity and DNA. The ability to tailor dosing sequences with alerts from once a year to 24 times a day and anything in between and ensure a high degree of accuracy can improve and save lives. Also the trial and error approach used in the dosing administration of some drugs such as blood thinners, hypertension management and certain forms of cancer, can be replaced by the correct dosing sequences the first time and every time.

Nowhere in medical science is there a greater need for more flexibility and the coming of age of genome and the true application of pharmacogenomics is placing urgency on these needs. The FDA and Research Pharmacist are limited by safety concerns of accidental misuse of under/overdosing and may relax some rules if reasonably confident that, like child-proof lids, there are significant inroads in addressing these factors. Critical new drugs abandoned because of dosing concerns, may be approved if simple, safe economical methods of ensuring adherence to dosing instructions, especially by the blind, the aged, and other physically and mentally challenged, are realized.

Devices in use are limited in application and do not generally or specifically address the needs of the blind; the aged and other physically challenged individuals. Some rely on color codes, which can be confusing to most and totally indistinguishable by others. Other devices rely on moving medicine from container to container, an obvious unsafe practice. Most focus only on the pill format and portability and do not address liquid, powders and gel medications and their containers and misuse. Still, even in a seemingly perfect environment, safety concerns of missed alerts due to laziness, forgetting to reload additional containers or simply leaving these devices at home and the adaptation of these devices to easily or automatically putting sequences back on track, are never addressed. Additionally, alarm creep due to response time, especially by challenged individuals, and progressive errors in accuracy and consistency are not recognized.

SUMMARY

The present invention is directed to methods and apparatus that satisfy the need for better patient compliance in the dosing of medicines. An apparatus for alerting a patient at medicine dosing times constructed according to the present disclosure will be small, flexible, inexpensive, and durable. An apparatus according to the present disclosure comprises an electronic timing mechanism that executes a medicine dosing schedule and alerts a person at times that correspond to the times at which doses of medicine should be administered. The electronic timing mechanism comprises a processor coupled to a memory, and a clock source for executing processor instructions at a uniform rate, and at least one timing channel for measuring elapsed time. The processor executes a control program which in turn executes a medicine dosing schedule. The dosing schedule, which resides in the memory, comprises information representing one or more dosing intervals, wherein a dosing interval comprises information corresponding to a finite amount of time, after which time a dose of medicine should be administered. The electronic timing mechanism produces at least one annunciator signal at the end of at least one dosing interval. The apparatus further comprises: at least one annunciator that is activated by one or more annunciator signals and one or more switches to enable human interaction with the apparatus. Furthermore, the apparatus is constructed using a flexible substrate upon which are mounted the electronic timing mechanism, one or more annunciators, and one or more switches. The flexible substrate is provided with a means of attaching the apparatus to other objects, and the flexibility of the apparatus is such that it can conform to curved surfaces of other objects.

The apparatus may further comprise a second timing channel for the purpose of measuring a second elapsed time. As a result of the second time elapsing, the control program may restart the execution of the dosing schedule from the beginning of the first dosing interval.

Additional features are presented in the present disclosure. The apparatus may be built with or without a power source, such as a battery or photovoltaic cell. In the case that the apparatus is built without a power source, it may be provided with a power source before it is used by an end user. A switch may be used to control power flow to the electronic timing mechanism. An on/off switch controlling power flow to the apparatus would enable manual restarts and extend the life of the apparatus.

The one or more annunciators may use audible, visual, or vibratory means to alert a person that a dose should be taken. The present invention specifically excludes a human readable time display, such as a liquid crystal clock display, thereby permitting the apparatus to be smaller and flexible.

The attachment means may be a pressure sensitive adhesive to facilitate a peel-and-stick method of applying the apparatus to a medicine container.

The apparatus may further comprise a flexible covering. The flexible covering may have human readable printing printed thereon. Human readable printing may be lettering, pictures, pictograms, or even braille for the visually challenged. The human readable printing in this example might read "once a day" or "24 Hrs". The flexible covering may have holes in it that allow the annunciators to be seen or heard without obstruction from the flexible covering.

A switch or multiple switches may be used to interact with the electronic timing mechanism such that activating a switch when an annunciator is activated causes the dosing schedule to advance to the next dosing interval. Activation of a switch may also deactivate an already activated annunciator. Activation of a switch may be used to indicate to the apparatus that a dose has been taken. Activating a switch may have multiple effects such as advancing the dosing schedule to the next dosing interval, deactivating an already activated annunciator, and indicating that a dose has been taken.

The apparatus may further comprise a means for data communication, which would enable the downloading of a new dosing schedule or an update of the control program. Examples of wired data communication means would be RS-232 serial communications and Universal Serial Bus (USB) communications. Wireless means for data communication, including infrared and radio frequency links, would be better still as their non contact-means of data communication would improve the efficiency of operation and ease of use.

A method according to the present disclosure comprises the steps of dispensing medicine into a container, selecting an alert apparatus preprogrammed with a dosing schedule appropriate for said dispensed medicine, wherein said dosing schedule comprises at least one dosing interval, wherein each dosing interval corresponds to an amount of time, wherein the alert apparatus activates at least one human perceivable annunciator at the end of at least one dosing interval, and attaching the alert apparatus to a surface of the container. The method may further comprise the step of deciding on an initial start time and then synchronizing the start time of the electronic timing mechanism with a separate time piece such as a wrist watch or wall clock. The method may further comprise the step of starting the flow of power to the electronic timing mechanism of the alert apparatus. The method may further comprise the step of starting the flow of power to the electronic timing mechanism of the alert apparatus.

Another method according to the present disclosure comprises the steps of dispensing medicine into a container, attaching an alert apparatus that works according to the present disclosure to a surface of the container, programming the alert apparatus with a dosing schedule that is appropriate for the medicine, the dosing schedule comprising at least one dosing interval, wherein a dosing interval corresponds to an amount of time, wherein the alert apparatus activates at least one human perceivable annunciator at the end of at least one dosing interval. The method may further comprise the step of deciding on an initial start time and then synchronizing the start time of the electronic timing mechanism with a separate time piece such as a wrist watch or wall clock. The method may further comprise the step of starting the flow of power to the electronic timing mechanism of the alert apparatus. The method may further comprise the step of printing on the alert apparatus human readable printing corresponding to the dosing schedule. The method may further comprise the step of activating a switch means on the alert apparatus thereby deactivating an already activated annunciator. The method may further comprise the step of activating a switch means on said alert apparatus thereby advancing said dosing schedule to the next dosing interval. The method may further comprise the step of activating a switch means on the alert apparatus to indicate that a medicine dose has been taken.

BRIEF DESCRIPTION OF THE DRAWINGS

These and other features, aspects, and advantages of the present invention will become better understood with regard to the following description, appended claims, and accompanying drawings where:

FIG. 6A shows an exemplary computer-readable data structure capable of storing dosing schedule information in accordance with an embodiment the invention;

FIG. 6B shows an exemplary computer-readable data structure capable of storing information associated with an individual dosing schedule entry in accordance with an embodiment of the invention;

LIST OF REFERENCE NUMBERS APPEARING IN THE FIGURES

1, 1*a*, 1*b*—Apparatus for alerting a patient at medicine dosing times.
2—Container.
4—Flexible substrate.
6—Attachment means.
7—Flexible covering.
8*a*, 8*b*, . . . —Openings in flexible covering.
9—Human readable printing.
10—Electronic timing mechanism.
12—Processor.
14—Clock source.
16—Memory.
18—Control program.
19*a*, 19*b*—First and second timing channels.
20—Dosing schedule.
21—Dosing schedule entry.
22—Switch interface.
24—Annunciator signal generator.
26—Annunciator interface.
28—Power source.
30, 30*a*, 30*b*—Annunciators.
32—Switch.
34, 34*a*, 34*b*—Annunciator connections.
36, 36*a*, 36*b*—Switch connections.
38, 38*a*, 38*b*—Power source connections.
40—Power switch.
42—Data communication interface.
44—External communication system.
46—Communication channel.

DESCRIPTION

Figure 1:
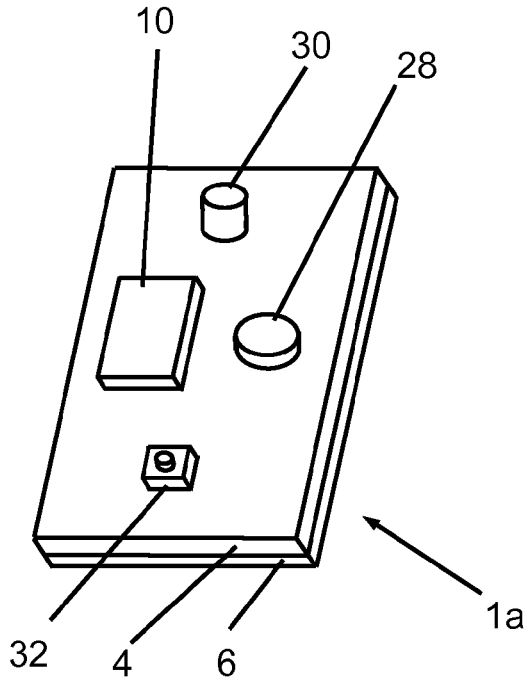
FIG. 1 shows a perspective view of an embodiment of the invention.

With reference now to FIG. 1, an embodiment of a version of the invention is shown as an apparatus for alerting a patient at medicine dosing times 1*a* comprising flexible substrate 4, attachment means 6, electronic timing mechanism 10, power source 28, switch 32, and annunciator 30. Attachment means 6 is adhered to the bottom surface of flexible substrate 4 for the purpose of attaching the apparatus to other objects. A preferred embodiment of attachment means 6 is a thin flexible film that presents a pressure sensitive adhesive on both of its surfaces, for example a double sided sticky tape. Attached to the top surface of flexible substrate 4 are electrical components: electronic timing mechanism 10, power source 28, switch 32, and annunciator 30. A preferred embodiment of flexible substrate 4 is a flexible printed circuit material, such as a polyimide film laminated with copper on one or both sides, which has the added advantage of being able to provide electrical connectivity between the electrical components of the apparatus. Use of flexible printed circuit material for flexible substrate 4 allows electrical components to be soldered in place while the electrical connections required to complete the circuit between electrical components are embodied as a printed circuit on flexible substrate 4.

Figure 7A:
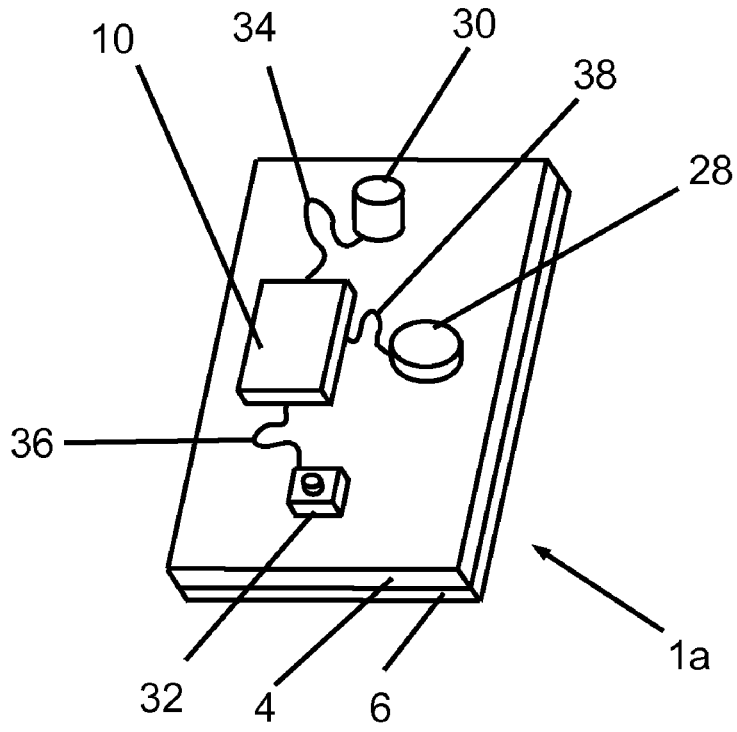
FIG. 7A shows perspective view of an embodiment of the invention in an not-flexed state.
Figure 7B:
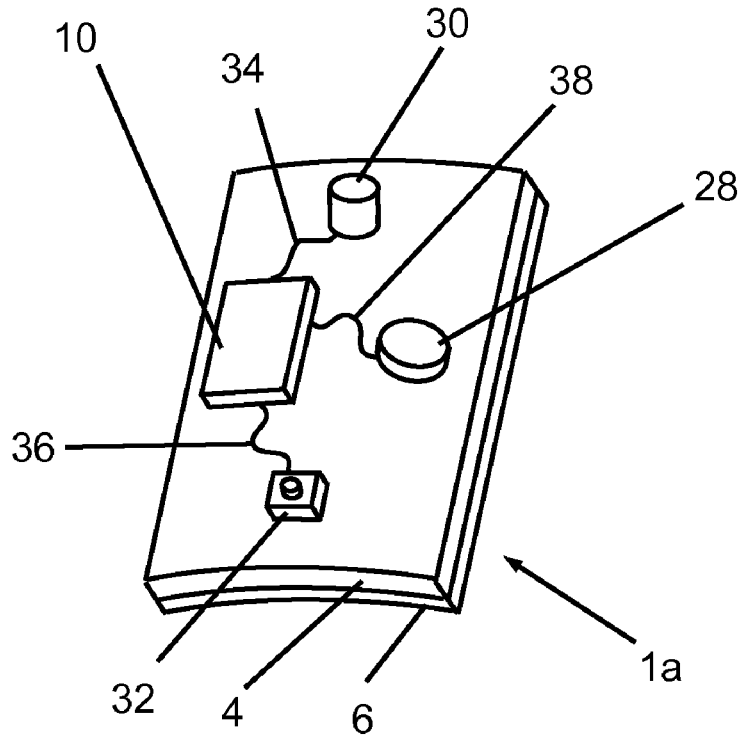
FIG. 7B shows a perspective view of the embodiment of FIG. 7A in a flexed state.

In an alternate embodiment, flexible substrate 4 may not use printed circuits on flexible substrate 4 to make electrical connection between electrical components. Instead, electrical connections between components may be made by means of discrete wires suspended above flexible substrate 4. Such wires may be designed and assembled on to the apparatus with enough slack to allow flexible substrate 4 to conform to a curved object without breaking the wires or the electrical connection between electrical components. FIG. 7A depicts an embodiment of apparatus 1*a* in which electrical connections are made by means of wires above flexible substrate 4. Apparatus 1*a* in FIG. 7A is shown in its not-flexed state. FIG. 7B illustrates the effect of flexing apparatus 1*a* of FIG. 7A upon annunciator connections 34, switch connections 36, and power source connections 38. FIG. 7B shows that the amount of slack in annunciator connections 34, switch connections 36, and power source connections 38 varies as apparatus 1*a* is flexed.

Figure 2:
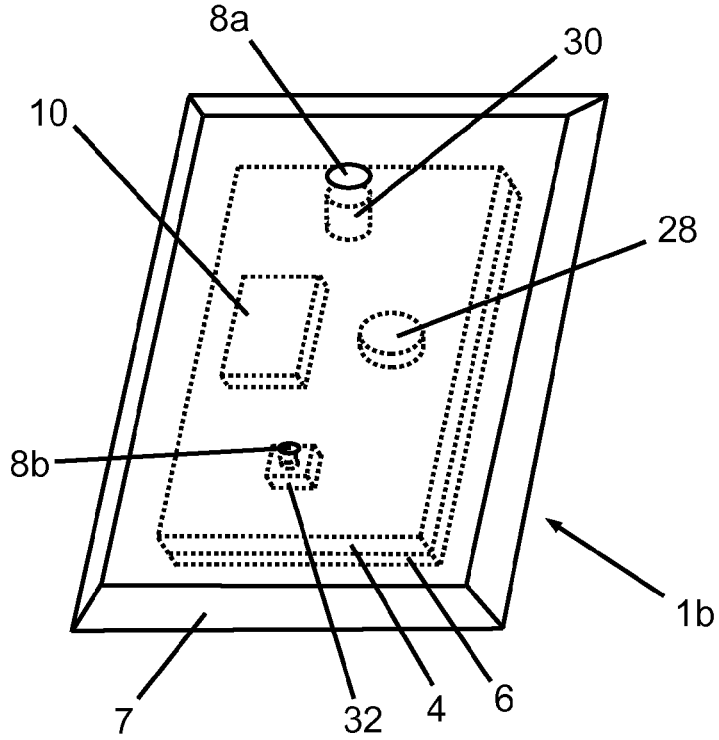
FIG. 2 shows a perspective view of another embodiment of the invention.

FIG. 2 shows an embodiment of another version of the invention as an apparatus for alerting a patient at medicine dosing times 1*b*. In this version flexible covering 7 is molded over the apparatus depicted in FIG. 1. Flexible covering 7 is shown with openings 8*a*, and 8*b* which allow user access to switch 32 and annunciator 30. A preferred embodiment of flexible substrate 7 is an elastic polymer compound of sufficiently low durometer to allow the apparatus to conform to curved surfaces of a size and shape routinely found on medicine containers. Durometers of less than 100 Shore A will be useful in various embodiments of the invention, with lower durometer numbers providing more flexibility. Flexible covering 7 is molded in such a way as to not interfere with the proper operation of attachment means 6. In an alternate embodiment, attachment means 6 may be omitted from attachment to flexible substrate 4, flexible covering 7 may be molded to encompass both top and bottom surfaces of flexible substrate 4, and attachment means 6 may then be attached to flexible covering 7. Flexible covering 7 may be fabricated with a material that presents a uniform color from the visible surface of the apparatus. A variety of colors may thereby be used to distinguish instances of the apparatus from one another.

Figure 3:
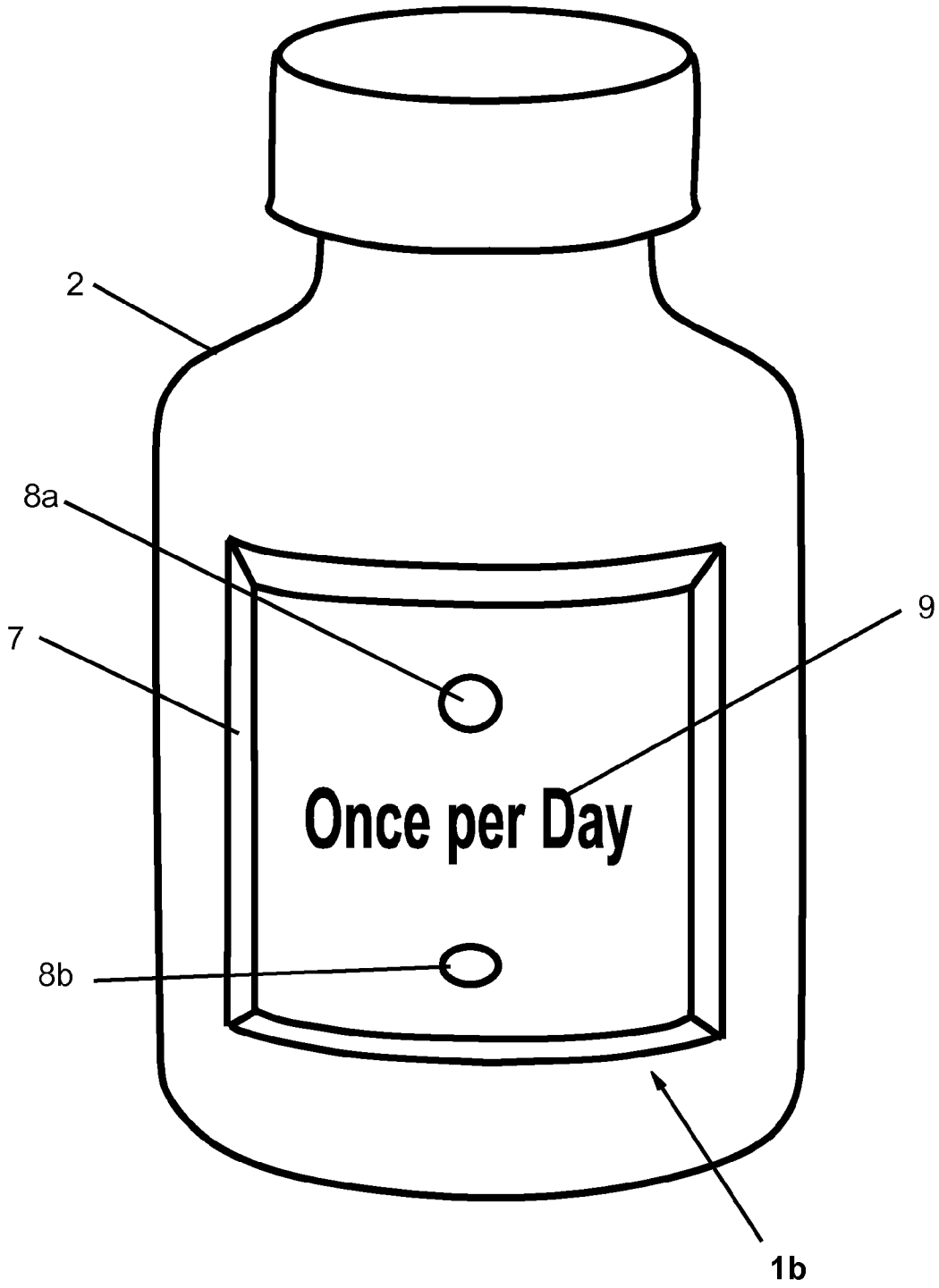
FIG. 3 shows a perspective view of an embodiment of the invention while attached to a medicine container.

FIG. 3 shows an embodiment of a version of the apparatus for alerting a patient at medicine dosing times 1*b* attached to container 2. Container 2 may be of any size and shape suitable for dispensing pharmaceutical pills, liquids, gels, and creams to patients. Since apparatus 1*b* is designed and constructed to be flexible it is able to conform to the curvature presented by container 2. The apparatus may be attached to nearly any surface, flat and curved surfaces included. The embodiment shown in FIG. 3 also depicts flexible covering 7, openings in flexible covering 8*a* and 8*b*, and human readable printing 9. In a medical application where container 2 contains medicine, it is typical that such a container is labeled with dosage and other important information. The flexibility of apparatus 1*b* allows direct attachment to the original pharmacy container which may be an advantage in preserving the information labeled on that container. When multiple medications are used, a patient may derive further benefit by using a different apparatus 1*b* on each container 2.

Figure 4:
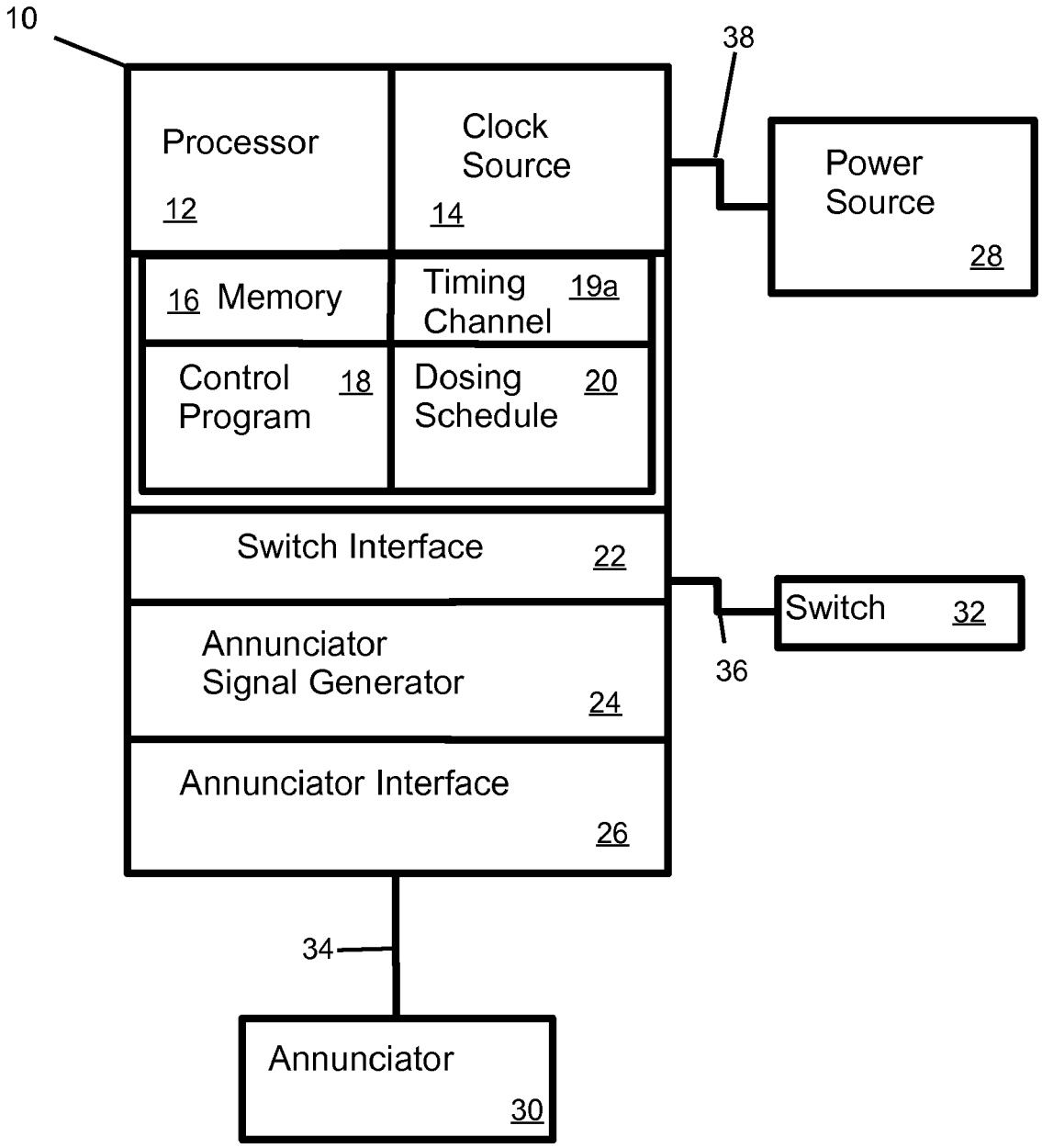
FIG. 4 shows a system diagram indicating structural and functional relationships among and within elements of the apparatus according to an embodiment of the invention.
Figure 10:
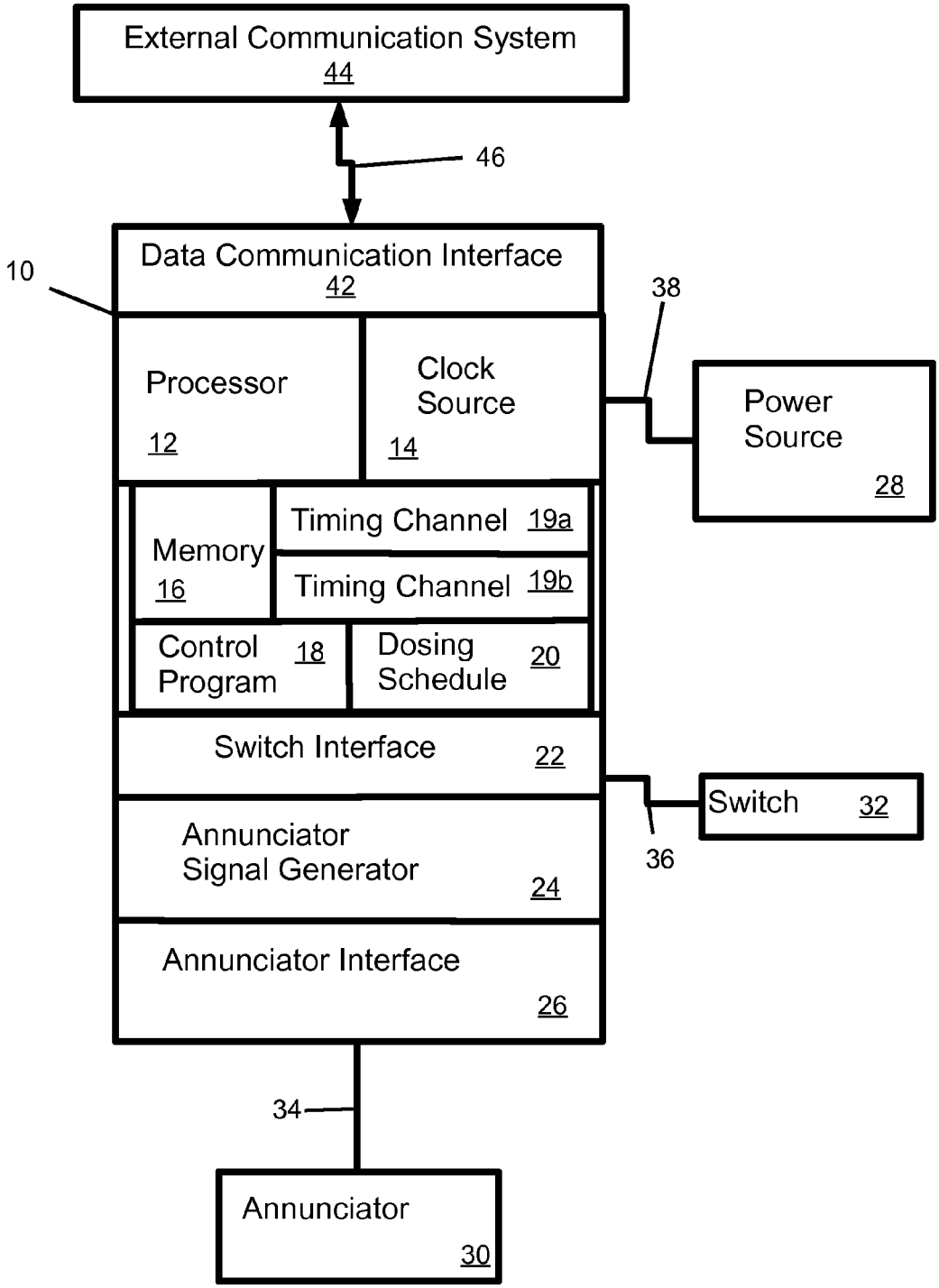
FIG. 10 shows a system diagram indicating structural and functional relationships among and within elements of the apparatus according to an an embodiment of the invention.

The structures and functions of the various embodiments of the apparatuses depicted in FIGS. 1, 2, 3, 7, and 8, may now be better understood with reference to FIG. 4. In FIG. 4 electronic timing mechanism 10 is shown comprising processor 12, clock source 14, memory 16, timing channel 19*a*, switch interface 22, annunciator signal generator 24, and annunciator interface 26. Located in memory 16 in computer-readable form are both control program 18 and dosing schedule 20. Processor 12 executes control program 18 which in turn executes dosing schedule 20. Clock source 14 allows processor 12 to execute instructions at a known rate. This known rate of execution enables processor 12 in conjunction with control program 18 to function as an timer capable of keeping track of at least one timing channel 19*a*. Control program 18 may start, stop, and reset timing channel 19*a*. Timing channel 19*a* operates to keep track of elapsed time durations. Dosing schedule 20 contains information that includes the duration of one or more time intervals that pertain to when a medicine dose should be taken. Control program 18 fetches individual entries one at a time from dosing schedule 20. Control program 18 causes timing channel 19*a* to time the amount of time associated with an individual dosing schedule entry. When control program 18 has ensured that the entire time associated with a dosing schedule entry has elapsed, control program 18 causes annunciator signal generator 24 to generate and send a signal through annunciator interface 26. The signal is propagated across annunciator connection 34 to annunciator 30. Annunciator 30 thereby alerts a patient that a medicine dose is due to be taken by making any one of visual indication, audible indication, vibratory indication, or any combination thereof.

electronic timing mechanism 10 is capable of independently maintaining and timing more than one channel of timing. By way of example, a first timing channel 19*a* may have a time period of 8 hours, while a second timing channel 19*b* may have a time period of 24 hours. electronic timing mechanism 10 is capable of starting, stopping, and reseting first timing channel 19*a* without interrupting the ongoing proper function of second timing channel 19*b*. Likewise, electronic timing mechanism 10 is capable of starting, stopping, and reseting second timing channel 19*b* without interrupting the ongoing proper function of first timing channel 19*a*. FIG. 10 depicts a functional block diagram of a version of an embodiment according to this disclosure in which first timing channel 19*a* and second timing timing channel are illustrated.

Processor 12 is operatively connected to switch interface 22 to receive indications of switch 32 activation by a user of the apparatus. Switch 32 communicates its state via switch connection 36 to switch interface 22 thereby making the state of switch 32 available to processor 12 for use during the execution of control program 18.

electronic timing mechanism 10 receives electrical power from power source 28 via power source connection 38. electronic timing mechanism 10 by virtue of its own power source connection 38 may then supply any power needed to operate annunciator 30 and switch 32. In this way both switch connection 36 and annunciator connection 30 may be used to transmit both power and data to annunciator 30 and switch 32 respectively.

Processor 12 may be a conventional microprocessor in which case both clock source 14 and memory 16 may be contained within the microprocessor itself. Clock source 14 may also be a crystal or other oscillator external to a microprocessor. Memory 16 may consist of Read Only Memory (ROM), or Random Access Memory (RAM), or a combination of RAM and ROM. In the case that processor 12 is a conventional microprocessor, memory 16 of either RAM or ROM type, or both types, may be contained in the microprocessor itself.

Control program 18 and dosing schedule 20 are both stored in computer-readable form in memory. Owing to the characteristics of the types of memory available, namely random access memory (RAM) and read-only memory (ROM) types, various embodiments may have different desirable characteristics. For example, if both control program 18 and dosing schedule 20 are stored in ROM they would be expected to be unalterable once manufacture of the apparatus is complete. This would provide the advantage of tamper proof operation and ease of use. This would also facilitate the use of human readable printing 9 on flexible covering 7 to indicate which dosing schedule is embodied by an instance of the apparatus.

In another version of an embodiment of the apparatus, control program 18 may reside in ROM, while dosing schedule 20 resides in RAM. Thus dosing schedule 20 may be loaded after manufacture of the apparatus is complete. This would provide the advantage of being able to load dosing schedule 20 into memory 16 just prior to dispensing a medication. There is a potential cost advantage to manufacturing just one design of apparatus that can be configured after manufacture with the required dosing schedule prior to use by a patient. In addition, medicine dosage may be tailored specifically to a patient on the basis of age, gender, weight, sensitivity, DNA, or other relevant factors.

The structure and function of annunciator signal generator 24, annunciator interface 26, and annunciator connection 30 depend upon what is required to activate annunciator 30. If, for example, annunciator 30 is a light emitting diode (LED), and blinking of that LED is the desired activation, then annunciator signal generator 24 may produce a signal that switches between ON and OFF states at the desired blink rate, annunciator interface 26 may be a transistor circuit controlled by said ON and OFF states to control a current that flows through annunciator connection 34, which may be a simple conductor, thereby causing current to flow and the LED to illuminate during the ON state, and no current to flow causing the LED to be dark during the OFF state.

If, as another example, annunciator 30 is an audible beeper, and a sounding of that beeper is the desired activation, then annunciator signal generator 24 may produce a signal that switches between ON and OFF states at the desired beep rate, annunciator interface 26 may be a transistor circuit controlled by said ON and OFF states to control a current that flows through annunciator connection 34, which may be a simple conductor, thereby causing current to flow and the beeper to emit sound during the ON state, and no current to flow and the beeper to be silent during the OFF state.

If, as another example, annunciator 30 is a small conventional speaker, and the desired activation is a human sounding voice that says "time to take your medicine" or any other desired phrase or set of phrases, then annunciator signal generator 24 may produce modulated waveforms that correspond to the desired sounds. Alternatively, annunciator signal generator 24 may retrieve computer-readable waveforms corresponding to the desired sounds from memory 16. Annunciator interface 26 may then take the waveforms and amplify and filter as needed to drive the speaker through annunciator connection 34, which may be one or more conductors.

If, as another example, annunciator 30 produces a sensible vibration when activated, such as produced by a tiny electrical motor with an unbalanced weight attached to its rotating shaft, then annunciator signal generator 24 may produce a signal that switches between ON and OFF states, annunciator interface 26 may be a transistor circuit controlled by said ON and OFF states to control a current that flows through annunciator connection 34, which may be a simple conductor, thereby causing current to flow and annunciator 30 to vibrate during the ON state, and no current to flow and the annunciator 30 to be still during the OFF state.

The state of switch 32 is conveyed through switch connection 36 to switch interface 22, which in turn makes the state of switch 32 available to processor 12 for use by control program 18. This allows a user of the apparatus to interact with the apparatus. In a version of an embodiment of the apparatus switch 32 may be a momentary contact switch, switch connection 36 may be a conductor, and switch interface 22 may be a general purpose input pin on a conventional microprocessor.

In another version of an embodiment of the apparatus switch 32 may be a capacitive sensing non-contact switch, switch connection 36 may be a pair of conductors, and switch interface 22 may be a capacitance sensing circuit that produces and ON state indication when a touch near the capacitive sensor is detected and produces an OFF state indication otherwise.

Figure 5A:
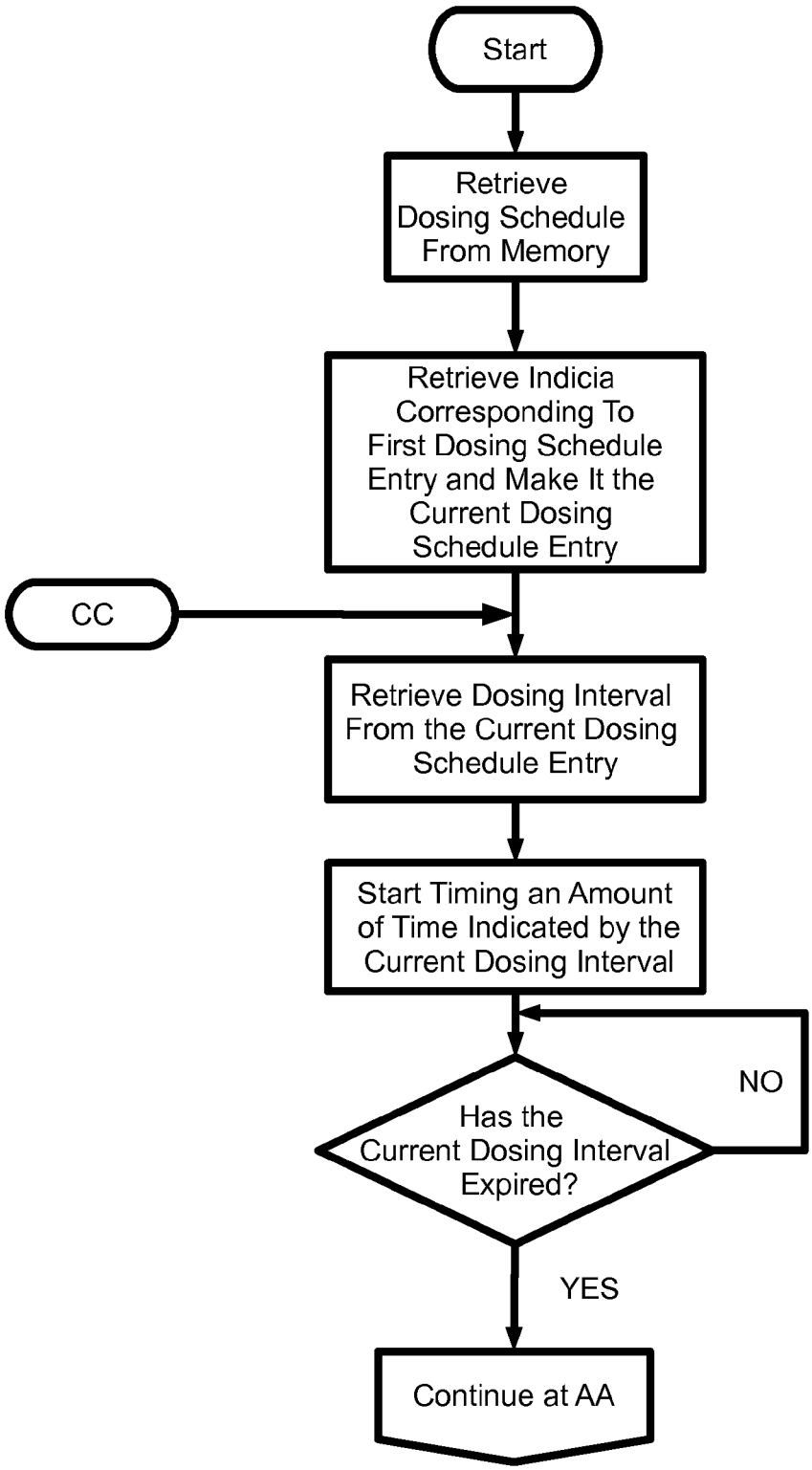
FIGS. 5A and 5B together are a program flowchart diagram illustrating a preferred method of implementing computer software control program according to an embodiment of the invention.
Figure 5B:
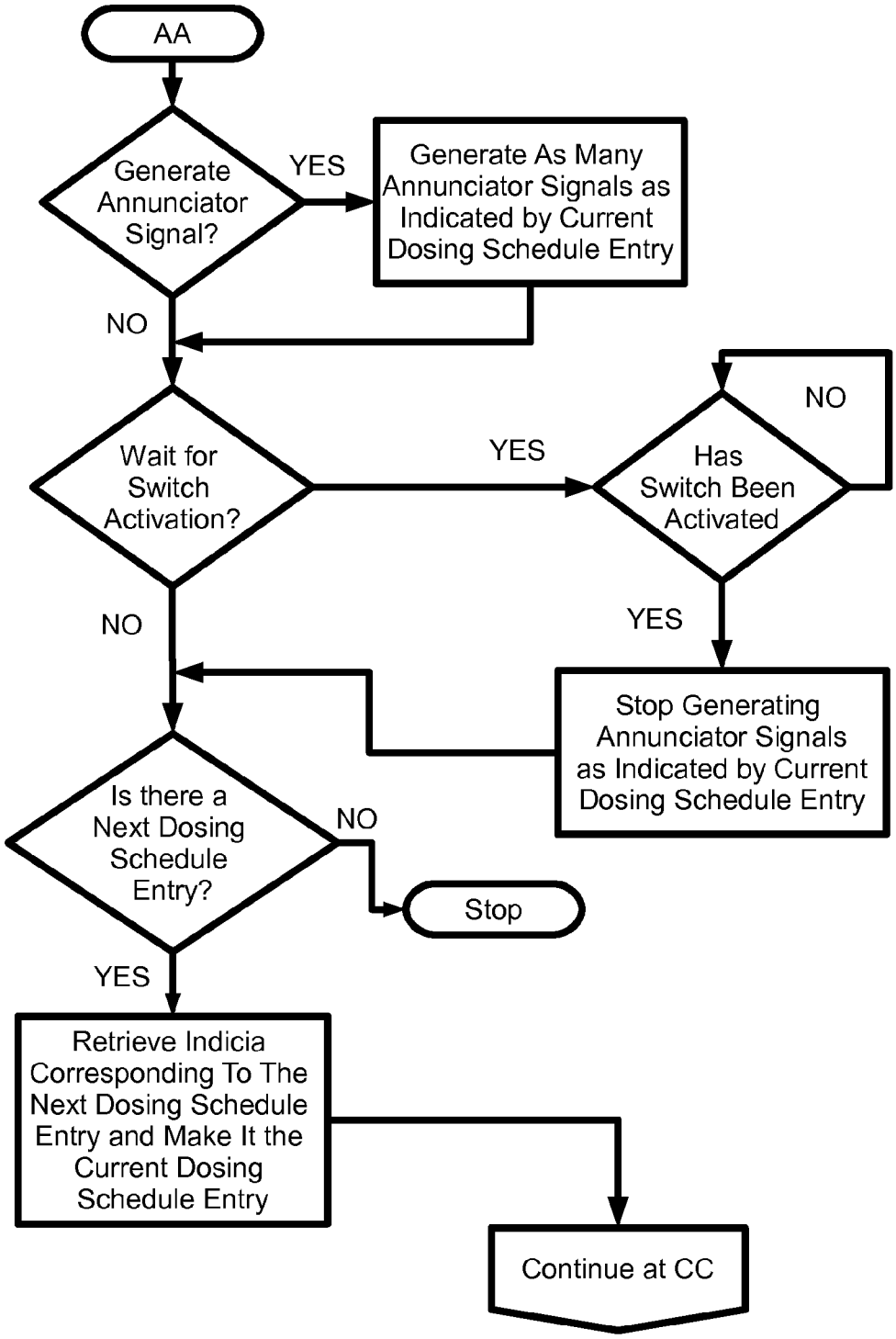

FIG. 5A and FIG. 5B taken together illustrate a program flowchart for a preferred embodiment of control program 18. Control program 18 has as its primary functions the execution of dosing schedule 20, activation of annunciator signal generator 24 for the current dosing schedule entry, and responding to user input. User input is made available to control program 18 through the state of switch 32. FIGS. 6A and 6B show exemplary data structures for dosing schedule 20, and dosing schedule entry 21 which are used in conjunction with control program 18. All control program sequence steps and all data structures are provided to processor 12 via computer readable media.

Control program 18 as shown in FIGS. 5A and 5B functions in the following way: dosing schedule 20 is executed one dosing schedule entry 21 at a time, annunciators are activated and deactivated when necessary, and user input is acted upon when necessary. As depicted in FIG. 6B, dosing schedule entry 21 comprises, but is not limited to, data representative of the time duration of a dosing interval, data indicating which of one or more annunciators to activate upon completion of the dosing interval, data indicating what actions to take upon sensing the activation of one or more switches, and data indicating which dosing schedule entry to execute upon the completion of the current dosing schedule entry. Including the ability to execute a prior dosing schedule entry gives the apparatus the ability to loop its execution of a portion or all of its dosing schedule. The apparatus may thereby be caused to repeat any number of dosing schedule entires indefinitely. At the end of a dosing interval, user input via one or more switches 32 may conditionally cause execution of additional control program sequences. If the current dosing schedule entry does not possess a next dosing schedule entry then control program 18 may not execute any more dosing schedule entries.

Control program 18 may start executing dosing schedule 20 immediately upon power being supplied to electronic timing mechanism 10. An alternate embodiment of control program 18 may wait for an activation of one or more switches 32 before starting the execution of dosing schedule 20.

Figure 8:
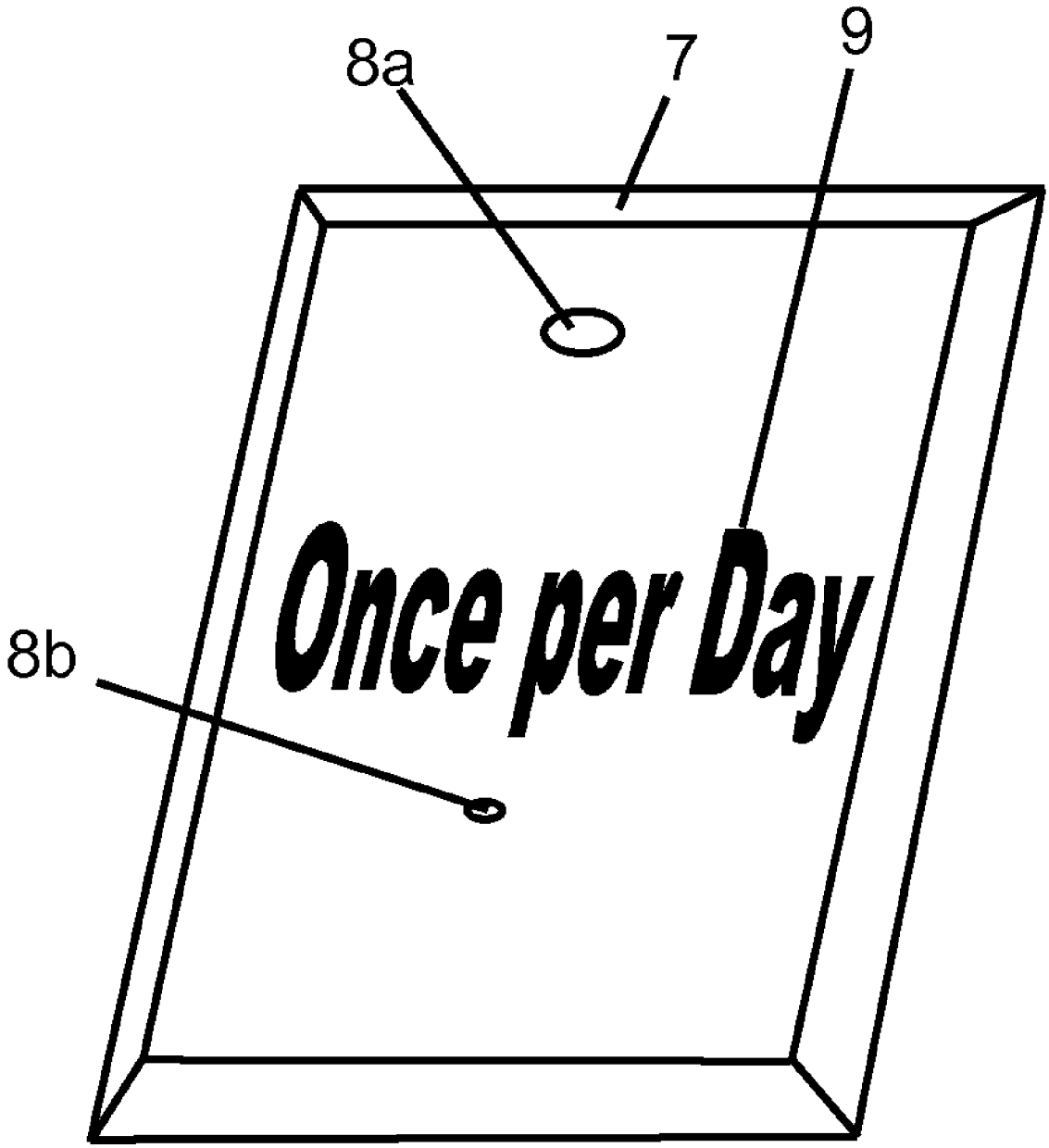
FIG. 8 shows a perspective view of an embodiment of the invention in which user readable printing is visible on the surface of the apparatus.

FIGS. 3 and 8 both show another beneficial feature, human readable printing 9, which may be printed on flexible covering 7. The presence of human readable printing 9 makes it easy to determine the dosing schedule programmed into the apparatus. Human readable printing is not restricted to just text, it may be textual, numeric, pictographic, braille, or any combination thereof. Use of pictograms indicating dosing schedule is particularly helpful in populations with low literacy rates or persons with visual or auditory impairments.

Human readable printing on a visible portion of the apparatus may be used to identify instances of the apparatus having different dosing schedules. Braille imprinting or embossing may be used as an aid to the visually impaired. Varied audible tones may be produced for the benefit of the visually impaired. LED and vibration annunciators will enable use of apparatus 1 by those with auditory impairments.

Figure 9:
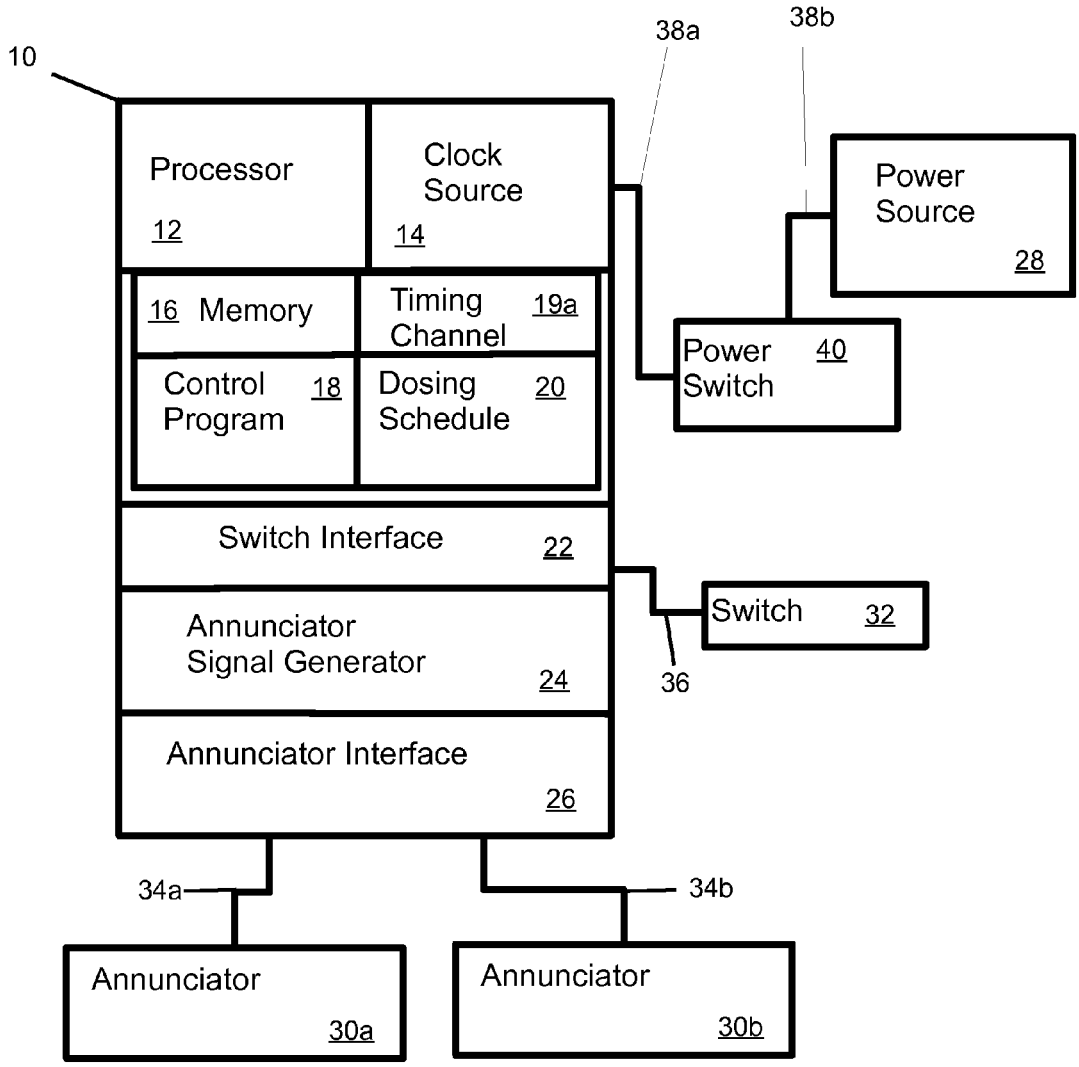
FIG. 9 shows a system diagram indicating structural and functional relationships among and within elements of the apparatus according to an an embodiment of the invention.

FIG. 9 illustrates another embodiment of the invention in which multiple annunciators are operatively included in the apparatus. Any mixture of multiple annunciators are permitted, for example, annunciator 30*a* may be a visible LED while annunciator 30*b* may be an audible beeper. Also shown in FIG. 9 is power switch 40 which is included for connecting and disconnecting power to electronic timing mechanism 10. Power switch 40 may be any switch, for example a miniature sliding single pole single throw switch, that is capable of interrupting and restoring power from power source 28 to a low power electronic device. Power switch connections 38*a* and 38*b* are electrically conductive elements connected so as to transmit electrical power from power source 28 to power switch 40, and from power switch 40 to electronic timing mechanism 10.

FIG. 10 illustrates another embodiment of the invention in which data communication interface 42 is operatively connected to processor 10 for the purpose of exchanging dosing schedules and other useful information between the apparatus and an external communication system 44 through a communication channel 46. A simple embodiment of data communication interface 42 would be a serial RS-232 interface that may be found on suitable microprocessors, which may use a pair of wires for communication channel 46, and a personal computer as external communication system 44.

Of particular merit would be a data communication interface 42 that does not require a wired connection with external communication system 44 to exchange information with that system. A wireless scheme would only require that communication channel be air or a vacuum. Suitable wireless data communication interfaces would use infrared or radio frequency to carry information between the apparatus and external communication system.

Data communication interface 42 may receive data from external communication system 44 including but not limited to a new dosing schedule 20 and updated control program 18. In addition, data communication interface 42 may transmit useful data to external communication system 44 including but not limited to current dosing schedule 20 and serial number information identifying that particular instance of apparatus for alerting a patient at medicine dosing times 1.

The version of the invention illustrated in FIG. 10 includes multiple timing channels, denoted as first timing channel 19*a* and second timing channel 19*b*. The inclusion of multiple timing channels allows multiple time periods to be timed independently. While first timing channel 19*a* is timing the time duration associated with current dosing schedule entry 21, second timing channel 19*b* may be independently timing a different time period. Control program 18 may cause various beneficial actions at the end of each time period timed by second timing channel 19*b*.

Embodiments of an apparatus for alerting a patient at medicine dosing times 1 operating in accordance with the present disclosure will produce at least one alert when the time has come to take a dose of medicine. It may happen then that the patient for whom the alert is intended is not present and hence is not able to interact with the apparatus 1 to deactivate annunciator 30 which is giving the alert. Since power consumption while an annunciator is activated is expected to be higher than when not activated, it is desirable to limit power consumption when the patient is not present to react to an alert. One method of saving power consumption in this scenario is to use a reduced power alert mode. An alert may initially activate in a full power alert mode. After an amount of time has passed without patient interaction with the apparatus 1 while full power alert mode is active, apparatus 1 may switch to a reduced power alert mode. The reduced power alert mode may continue to produce an alert, however, it will do so in a manner that uses less power than the full power alert mode. By way of example, full power alert mode may comprise an audible tone that is produced at full volume, while reduced power alert mode may comprise an audible tone that is produced at less than full volume. Various full power and reduced power alert modes may be constructed for any or all of the annunciators used in the apparatus.

Figure 11:
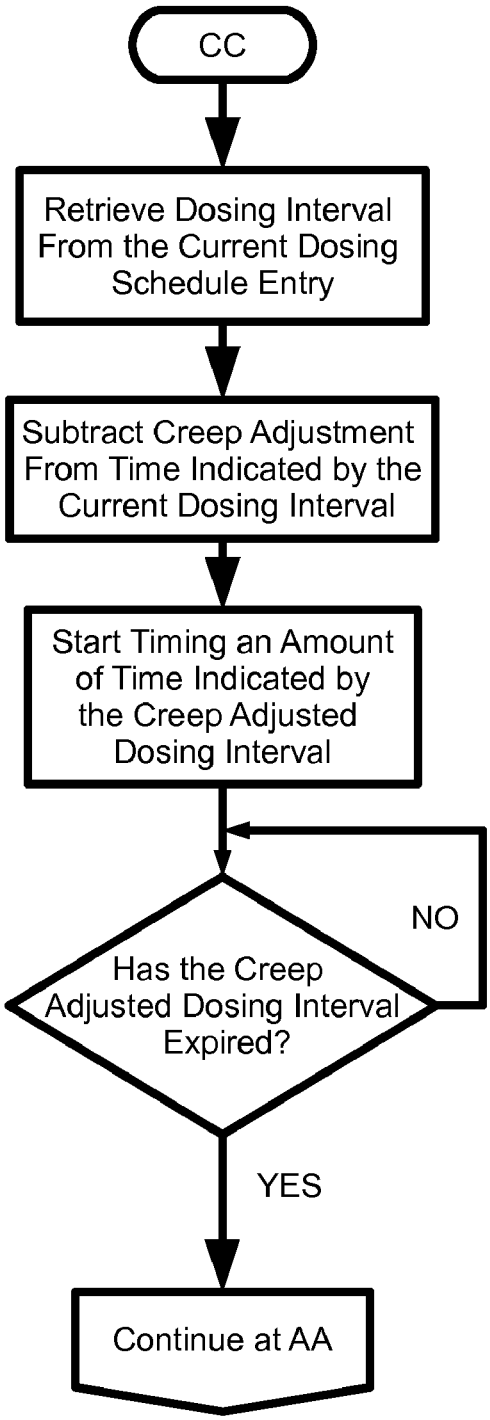
FIG. 11 is a program flowchart diagram illustrating a method for eliminating alarm creep according to an embodiment of the invention.

FIG. 11 embodies a method to combat the problem of alarm creep which arises in the timing of dosing times. Using a concrete example to illustrate the principle of alarm creep, consider a required dosing schedule of one dose per 12 hours. Suppose then that the first dosing interval starts and then expires in exactly 12 hours, and the apparatus alerts the patient by means of activating one or more annunciators. Five minutes later, when the patient has taken the required dose of medicine, the patient activates a switch on the apparatus to indicate that the dose has been taken. If the 12 hour dosing interval is started at this point then the second alert will occur 24 hours and 5 minutes after the the timing of dosing intervals began. In this example, 5 minutes of alarm creep have occurred after the first dosing interval. If continued in this manner, alarm creep will accumulate for every dose and alerts will be generated later and later because of the creep. It is therefor desirable to eliminate alarm creep.

One method of controlling alarm creep is the following: Second timing channel 19*b* may be used to time recurring 24 hour periods. Each time that control program 18 determines that second timing channel 19*b* has timed the entire 24 hour duration it may cause a restart of dosing schedule 20, after which second timing channel 19*b* may be restarted to time another 24 hour period. The effect of a restart of dosing schedule 20 every 24 hours is that alarm creep is reset to zero every time dosing schedule 20 is restarted.

Another method of eliminating alarm creep is to start timing the next dosing interval immediately upon the expiration of the current dosing interval. The patient alert would persist until cleared by the patient through the activation of a switch on the apparatus. Since the next dosing interval is already being timed when the alert is cleared there can be no alarm creep. Since alarm creep may be eliminated by this method, future patient alerts would occur exactly on schedule. In the concrete example of one alert per 12 hours, all subsequent alerts would occur at exact 12 hours intervals with no accumulated creep.

A method of reducing alarm creep is to issue an alert prior to the expiration of a dosing interval. This can be very useful in counteracting time loses that occur due to a patient's response time in responding to and alert. This method is illustrated by the program flowchart diagram of FIG. 11. FIG. 11 is best understood in the context the software program flowchart of FIG. 5A, where flowchart connectors AA and CC in FIG. 11 indicate the same flowchart connections as depicted in FIG. 5A. Using the concrete example of one dose per 12 hours, a fixed amount of time, for example 15 minutes, is subtracted from the 12 hour dosing interval. 12 Hours minus 15 minutes becomes the creep adjusted dosing interval. At the expiration of the creep adjusted dosing interval a patient alert may be produced by the apparatus.

While the foregoing descriptions are intended to convey the structure and function of elements comprising preferred embodiments of the invention, the disclosure now turns to the manner and method of using various embodiments of the invention.

One particularly effective way of embodying the invention in an apparatus is for the dosing schedule to be preprogrammed at the factory and on that apparatus print a unique, clearly visible, human readable, representation of that dosing schedule. Human nature indicates that the easier a task is to perform the more likely a person is to comply with the performance of that task. Using a human readable representation of the dosing schedule in association with a preprogrammed dosing schedule reduces the number of steps that need to be performed to use the apparatus. A person would simply attach to the medicine container an apparatus that has been preprogrammed with a dosing schedule that matches the requirements of the medication. A person may decide on an initial start time, with reference to a separate time piece, and then take the first dose. When the first dose is taken execution of the dosing schedule may be caused to commence within the apparatus, thereby synchronizing the execution of the dosing schedule with the separate time piece. Depending on the embodiment of the invention, the apparatus may or may not have a user accessible power switch. If a power switch is user accessible then it may be switched on at the time of the first dose and thereafter the dosing schedule will execute according to the programming instantiated at the factory. If no power switch is user accessible then the user may press one or more switches to indicate that the first dose has been taken and thereafter the dosing schedule will execute according to the programming instantiated at the factory. The flexibility of the apparatus allows for it to be attached to and conform to surfaces, thereby allowing it to be directly affixed to the medicine container to which its dosing schedule pertains. Thus people with many medicines to take may use many such apparatuses, each one executing a dosing schedule appropriate to the medicine in the container to which it is attached. An apparatus attached to each medicine container helps to avert confusion by producing alerts that are specific to the medicine in each specific container.

After the apparatus has started executing its dosing schedule it will produce human perceivable alerts, by means of one or more of its annunciators, according to the individual dosing schedule entry that it is executing at the time. Upon noticing an alert, the person will take the required medicine dose and then indicate to the device, by means of one or more switches, that the required dose has been taken. The apparatus will continue operation by executing the next dosing schedule entry. If there is no next dosing schedule entry then the apparatus will become dormant and issue no more alerts. In a preferred embodiment, a single switch activation by the person may serve to simultaneously silence an alert, confirm that a dose has been taken, and advance the dosing schedule to the next dosing schedule entry.

In another embodiment of the invention it is envisioned that the apparatus may be dispensed at the same time that the medicine itself is dispensed by a pharmacist or other persons permitted to dispense medication. When dispensed by a pharmacist it may be beneficial to provide the pharmacist with an apparatus that is not preprogrammed with a dosing schedule. The pharmacist could program the appropriate dosing schedule into the apparatus, attach the now programmed apparatus to a medicine container and then dispense the medicine into the same container. The steps of programming, attaching, and dispensing could naturally be performed in any order and still accomplish the same objective. Programming the apparatus at the point of dispensing is made easier by using any of the various means of programming already disclosed, including infrared and radio frequency. After dispensing by the pharmacist, the apparatus may be used to alert a patient at the appropriate medicine dosing times.

Although the present invention has been described in considerable detail with reference to certain preferred versions thereof, other versions are possible. For example, there are many beneficial uses of a alert apparatus constructed as described in this disclosure. A 7 day alarm period may be useful for the scheduling of personal weekly activities such as taking out the trash or moving the car between alternate parking districts. A 1 hour alarm period may be useful for tracking parking meter expiration. A 3 month alarm period may be useful for prompting the replacement of filters in many situations. A 3 day alarm period may be useful in article rental situations. Larger apparatus may be constructed in keeping with the present disclosure, such apparatus additionally comprising permanent power supply, louder annunciators, and brighter annunciators. In addition, versions of the invention may be attached directly to or may be built in to other fixtures such as household medicine cabinets. Such apparatus may be used either independently or in conjunction with apparatuses placed on original medicine containers. Therefor, the spirit and scope of the appended claims should not be limited to the description of the preferred versions contained herein.

Other versions and embodiments of alert apparatus consistent with the present disclosure are possible. Alert apparatus may consider the fact that most medicine dosing schedules recognize sleep time at night and should function to keep those hours quiet. Also, because some homes are large and persons may keep their medicines in a cabinet that may be closed most of the time, the following additional disclosure will address ways of helping to ensure that alerts are detected. An amplification device, capable of detecting and amplifying sound and powered by batteries or regular home power supply can be placed in close proximity by attaching to or being built into medicine cabinets. Once activated such an amplification device may continue at full power until reset. Amplification devices may amplify audible signals, visual signals or both and thereby help in the perception of alerts by persons in larger homes.

Any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" in the claims herein is not intended to invoke the provisions of 35 U.S.C. Section 112, Paragraph 6.

What is claimed is:

1. A flexible apparatus with no LCD or time of day display for alerting a person at medicine dosing times comprising:

a) an electronic timing mechanism for executing a dosing schedule and producing one or more annunciator signals, i) said electronic timing mechanism comprising: a processor operatively coupled to a memory for executing a control program, said control program stored in computer-readable form in said memory, said control program executing said dosing schedule, a clock source for executing said control program in said processor at a uniform rate, said control program maintaining a first timing channel for measuring elapsed time between doses;

ii) said dosing schedule being stored in computer-readable form in said memory, said dosing schedule comprising information representing times associated with at least one dosing interval, wherein the dosing interval is the time between doses, and wherein the dosing schedule pertains to one medicine;

iii) said dosing interval comprising information corresponding to a finite time interval;

iv) said first timing channel measuring elapsed time corresponding to said dosing interval;

v) said electronic timing mechanism producing at least one said annunciator signal at the end of at least one said dosing interval;

b) one or more annunciators operatively and flexibly coupled to said electronic timing mechanism such that said one or more announcer signals causes activation of said one or more annunciators for alerting a person;

c) one or more switch means operatively and flexibly coupled to said electronic timing mechanism for interaction with said electronic timing mechanism; wherein one said switch means is responsive to user input and configured to deactivate a previously activated annunciator, and, d) a flexible substrate on which are directly attached and configured to operate while said flexible substrate is flexed, said electronic timing mechanism, said one or more annunciators, and said one or more switch means, wherein a portion of said flexible substrate is configured to provide a flexible operative coupling between at least one switch means and said electronic timing mechanism, and, wherein a portion of said flexible substrate is configured to provide a flexible operative coupling between at least one said electronic timing mechanism and at least one said annunciator.

2. The apparatus of claim 1 further comprising: data communication means operatively coupled to the processor for sending data.

3. The apparatus of claim 2 wherein said data comprises one or more alert signals.

4. The apparatus of claim 1 further comprising a second timing channel for measuring elapsed time corresponding to a second finite time interval, wherein said control program restarts execution of said dosing schedule from the beginning of said dosing schedule when said second finite time interval has elapsed, wherein the second finite time interval is independent from the first finite time interval, a) apparatus of claim one configured to simultaneously start both timing channels 1 and timing channel 2, b) apparatus of claim one with a second timing channel preprogrammed to emit a signal every 24 hours to restart the timing sequence of the first timing channel, c) apparatus of claim one with a second timing channel programmed to provide an uninterruptable automatic function by stopping and starting the mechanism of the first timing channel at preset time intervals throughout a daily cycle.

5. The apparatus of claim 1 further comprising a combination of annunciators such that alerts can be tailored to the specific challenges of the user in that a person with impaired vision may only require a device with an audible and vibratory annunciator.

6. The apparatus of claim 1, wherein the flexible substrate comprises a top side and a bottom side wherein said attachment means is a pressure sensitive adhesive on the bottom side of the flexible substrate for attaching apparatus to the curved surface of medicine containers.

7. The apparatus of claim 1, wherein said apparatus additionally comprises a power source operatively connected to said electronic timing mechanism for executing the start of both timing channels simultaneously.

8. The apparatus of claim 7, wherein one of said one or more switch means is operatively connected for interrupting and restoring power to said electronic timing mechanism.

9. The apparatus of claim 1, wherein at least one of said one or more annunciators produces an audible indication.

10. The apparatus of claim 1, wherein at least one of said one or more annunciators produces a visible indication.

11. The apparatus of claim 1, wherein at least one of said one or more annunciators produces a vibratory indication.

12. The apparatus of claim 1 further comprising a flexible covering molded onto the top side of flexible substrate forming a protective shield for components attached onto flexible substrate.

13. The apparatus of claim 12 further comprising readable printing, written or engraved of an Initial Start Time and timing intervals corresponding to said dosing schedule, wherein said readable printing is visible on said flexible covering.

14. The apparatus of claim 1 that generates a vibratory signal configured to and capable of activating an external amplifying device which detects and emits a second alert.

15. The apparatus of claim 1, wherein the activation of one of said switch means causes said control program to advance said dosing schedule to the next dosing interval.

16. The apparatus of claim 1 further comprising: data communication means operatively connected to said processor for receiving said dosing schedule from a communication system and storing said dosing schedule in said memory.

17. The apparatus of claim 16, wherein said data communication means operates without requiring physical contact between the apparatus and said communication system.

18. A method of alerting a person at medicine dosing times comprising the steps of:

a) dispensing medicine into a container;

b) selecting an alert apparatus preprogrammed with a dosing schedule appropriate for said dispensed medicine, wherein said alert apparatus comprises:

i) an electronic timing mechanism executing a dosing schedule and producing one or more annunciator signals, said electronic timing mechanism comprising: a processor operatively coupled to a memory and executing a control program, said control program stored in computer-readable form in said memory, said control program executing said dosing schedule, a clock source for executing said control program in said processor at a uniform rate, said control program maintaining a first timing channel for measuring elapsed time between doses; said dosing schedule being stored in computer-readable form in said memory, said dosing schedule comprising information representing times associated with at least one dosing interval, wherein the dosing interval is the time between doses; said dosing interval comprising information corresponding to a finite time interval, and wherein the dosing schedule pertains to one medicine; said first timing channel measuring elapsed time corresponding to said dosing interval; said electronic timing mechanism producing at least one said annunciator signal at the end of at least one said dosing interval;

ii) one or more annunciators operatively and flexibly coupled to said electronic timing mechanism such that said one or more annunciator signals causes activation of said one or more annunciators for alerting a person;

iii) one or more switch means operatively and flexibly coupled to said electronic timing mechanism; wherein one said switch means is responsive to user input and configured to deactivate a previously activated annunciator, and, iv) a flexible substrate on which are directly attached and configured to operate while said flexible substrate is flexed said electronic timing mechanism, said one or more annunciators, and said one or more switch means, wherein a portion of said flexible substrate is configured to provide a flexible operative coupling between at least one switch means and said electronic timing mechanism, and, wherein a portion of said flexible substrate is configured to provide a flexible operative coupling between said electronic timing mechanism and at least one said annunciator; and, c) attaching said alert apparatus to said container such that said alert apparatus physically conforms to a surface of said container.

19. The method of claim 18 further comprising the step of starting the flow of power to said alert apparatus.

20. The method of claim 18 further comprising the step of deciding on an initial start time and synchronizing the start of said dosing schedule with a separate time piece.

21. A method of alerting a person at medicine dosing times comprising the steps of:

a) dispensing medicine into a container;

b) attaching an alert apparatus to said container such that said alert apparatus physically conforms to a surface of said container; wherein said alert apparatus comprises:

i) an electronic timing mechanism executing a dosing schedule and producing one or more annunciator signals, said electronic timing mechanism comprising: a processor operatively coupled to a memory and executing a control program, said control program stored in computer-readable form in said memory, said control program executing said dosing schedule, a clock source for executing said control program in said processor at a uniform rate, said control program maintaining a first timing channel for measuring elapsed time; said dosing schedule being stored in computer-readable form in said memory, said dosing schedule comprising information representing times associated with at least one dosing interval, wherein the dosing interval is the time between doses; said dosing interval comprising information corresponding to a finite time interval, and wherein the dosing schedule pertains to one medicine; said first timing channel measuring elapsed time corresponding to said dosing interval; said electronic timing mechanism producing at least one said annunciator signal at the end of at least one said dosing interval;

ii) one or more annunciators operatively and flexibly coupled to said electronic timing mechanism such that said one or more annunciator signals causes activation of said one or more annunciators for alerting a person;

iii) one or more switch means operatively and flexibly coupled to said electronic timing mechanism interacting with said electronic timing mechanism; wherein one said switch means is responsive to user input and configured to deactivate a previously activated annunciator, and, iv) a flexible substrate on which are directly attached and configured to operate while said flexible substrate is flexed said electronic timing mechanism, said one or more annunciators, and said one or more switch means, wherein a portion of said flexible substrate is configured to provide a flexible operative coupling between at least one switch means and said electronic timing mechanism, and, wherein a portion of said flexible substrate is configured to provide a flexible operative coupling between at least one said electronic timing mechanism and at least one said annunciator; and, c) programming said alert apparatus with a dosing schedule appropriate for said dispensed medicine, wherein said dosing schedule comprises at least one dosing interval, wherein each dosing interval corresponds to an amount of time, wherein said alert apparatus activates at least one human perceivable annunciator at the end of at least one dosing interval.

22. The method of claim 21 further comprising the step of starting the flow of power to said alert apparatus.

23. The method of claim 21 further comprising the step of deciding on an initial start time and synchronizing the start of said dosing schedule with a separate time piece.

24. The method of claim 21 further comprising the step of printing on said alert apparatus readable information corresponding to said Initial Start Time and timing interval.

25. The method of claim 21 further comprising the step of activating a switch means on said alert apparatus thereby deactivating an already activated annunciator.

26. The method of claim 21 further comprising the step of activating a switch means on said alert apparatus thereby advancing said dosing schedule to the next dosing interval.

27. The method of claim 21 further comprising the step of activating a switch means on said alert apparatus to simultaneously advance the dosing schedule and indicate that a medicine dose has been taken.

28. A system for alerting a person at medicine dosing times comprising:

a) a flexible alert apparatus for producing a first alert for at least one medicine dosing time, said alert apparatus comprising:

i) an electronic timing mechanism for executing a dosing schedule and producing one or more annunciator signals;

A) said electronic timing mechanism comprising: a processor operatively coupled to a memory for executing a control program, said control program stored in computer-readable form in said memory, said control program executing said dosing schedule, a clock source for executing said control program in said processor at a uniform rate, said control program maintaining a first timing channel for measuring elapsed time;

B) said dosing schedule being stored in computer-readable form in said memory, said dosing schedule comprising information representing times associated with at least one dosing interval, wherein the dosing schedule pertains to one medicine;

C) said dosing interval comprising information corresponding to a finite time interval; wherein the dosing interval is the time between doses;

D) said first timing channel measuring elapsed time corresponding to said dosing interval;

E) said electronic timing mechanism producing at least one said annunciator signal at the end of at least one said dosing interval;

ii) one or more annunciators operatively and flexibly coupled to said one or more electronic timing mechanism such that said one or more annunciator signals causes activation of said one or more annunciators for alerting a person;

iii) one or more switch means operatively and flexibly coupled to said electronic timing mechanism for interaction with said electronic timing mechanism; wherein one said switch means is responsive to user input and configured to deactivate a previously activated annunciator and, iv) a flexible substrate on which are directly attached and configured to operate while said flexible substrate is flexed said electronic timing mechanism, said one or more annunciators, and said one or more switch means, wherein a portion of said flexible substrate is configured to provide a flexible operative coupling between at least one switch means and said electronic timing mechanism, and, wherein a portion of said flexible substrate is configured to provide a flexible operative coupling between at least one said electronic timing mechanism and at least one said annunciator;

b) an amplification apparatus external to said alert apparatus and powered separately from said alert apparatus wherein the amplification apparatus is configured for detecting said first alert emitted by said alert apparatus and wherein said amplifier apparatus is configured for producing a second alert.

* * * * *